US009458716B2

(12) United States Patent
Horn et al.

(10) Patent No.: US 9,458,716 B2
(45) Date of Patent: Oct. 4, 2016

(54) PROP HEAD BEARING DEVICE FOR SHIELD SUPPORTS

(71) Applicant: Caterpillar Global Mining Europe GmbH, Lünen (DE)

(72) Inventors: Swetlana Horn, Dortmund (DE); Ulrich Pletsch, Lünen (DE)

(73) Assignee: Caterpillar Global Mining Europe GmbH, Lünen (DE)

( * ) Notice: Subject to any disclaimer, the term of this patent is extended or adjusted under 35 U.S.C. 154(b) by 140 days.

(21) Appl. No.: 14/215,978

(22) Filed: Mar. 17, 2014

(65) Prior Publication Data

US 2014/0286713 A1 Sep. 25, 2014

(30) Foreign Application Priority Data

Mar. 20, 2013 (EP) ..... 13160211

(51) Int. Cl.
*E21D 15/55* (2006.01)
*E21D 23/04* (2006.01)
*E21D 23/00* (2006.01)

(52) U.S. Cl.
CPC ..... *E21D 15/55* (2013.01); *E21D 23/006* (2013.01); *E21D 23/04* (2013.01); *E21D 23/049* (2013.01); *Y10T 29/49826* (2015.01)

(58) Field of Classification Search
CPC ..... E21D 15/55
USPC ..... 299/33; 405/288, 290, 291, 296
See application file for complete search history.

(56) References Cited

U.S. PATENT DOCUMENTS

| | | | | |
|---|---|---|---|---|
| 7,201,541 | B2 | 4/2007 | Barmann | |
| 2010/0024377 | A1* | 2/2010 | Ahmed | F16G 15/06 59/86 |

FOREIGN PATENT DOCUMENTS

| | | | |
|---|---|---|---|
| CN | 201826866 | U | 5/2011 |
| DE | 11 97 836 | B | 8/1965 |
| DE | 12 16 224 | B | 5/1966 |
| DE | 36 40 008 | A1 | 5/1988 |
| GB | 2098255 | A | 11/1982 |
| RU | 2165024 | C2 | 4/2001 |

OTHER PUBLICATIONS

European Search Report for EP Application No. 13160211.2-1605, Jul. 25, 2013, 3 pages.

* cited by examiner

*Primary Examiner* — Sunil Singh

(57) ABSTRACT

A prop head bearing device used for a shield support and to receive a prop head includes a prop head bearing main body with a prop head receiving portion, a flange adjacent to the prop head receiving portion and a flange bore, and a receiving portion adjacent to the flange and remote from the prop head receiving portion. The prop head bearing device may also include a securing element including a securing element bore adapted in shape to the receiving portion, such that in the mounted state the securing element is locked with respect to the bore direction of the flange bore and that the securing element bore is aligned to the flange bore.

14 Claims, 4 Drawing Sheets

PROP HEAD BEARING DEVICE FOR SHIELD SUPPORTS

CROSS-REFERENCE TO RELATED APPLICATIONS

This application claims the benefit of priority to European Patent Application Number 13160211.2, having a filing date of Mar. 20, 2013, the complete disclosure of which is hereby incorporated by reference for all purposes.

TECHNICAL FIELD

The present disclosure generally relates to a prop head bearing device configured to be disposed between a shield canopy and a hydraulic prop of a shield-type support frame for underground use, and to securely receive a prop head of the hydraulic prop, and more particularly to a prop head bearing device including a separate securing element for locking a securing pin configured to secure the prop head to the prop head bearing.

BACKGROUND

In mining it is conventional to use a ball joint to connect the prop head of a hydraulic prop and the shield canopy of a shield-type support frame, for instance, a so-called shield support. In known shield-supports, use is made of a prop head bearing which forms the socket, wherein the securing element is mounted so as to be pivotably around a swivel axis. A movable locking bolt, releasably connected to the prop head receiving portion, extends parallel to and at a distance from the swivel axis. When in the secured position, the side of the securing element remote from the prop head of the hydraulic prop abuts the locking bolt, so that the securing element cannot accidentally be twisted out of the secured position.

GB 2 098 255 A discloses a mechanical connection device between head or foot of a prop and the canopy or base of roof supports. The device disclosed therein comprises a pivot pin which extends trough the head of the prop and has at each end a flat which is adapted to bear against a plane surface of a holding member integral with a canopy or base. The pivot pin is locked by means of two stirrups fixed by pin elements in holes to the holding member.

Further, U.S. Pat. No. 7,201,541 B2 discloses a prop head bearing between the roof bar and the prop of a shield-type support frame, comprising a ball-joint socket on the roof bar and opened towards the prop for receiving a ball-joint head on the prop, with at least one movable securing pin. When in a secured position, the securing pin engages in a recess in the joint head to prevent accidental lifting of the joint head out of the socket, and with a locking pin which locks the securing pin in the secured position.

The present disclosure is directed, at least in part, to improving or overcoming one or more aspects of prior systems.

SUMMARY OF THE DISCLOSURE

According to a first aspect of the present disclosure, a prop head bearing device configured to be attached to a shield canopy of a shield support in underground mining applications and to receive a prop head of a hydraulic prop may comprise a prop head bearing main body and a first securing element. The prop head bearing main body may include a prop head receiving portion, a first flange, which is disposed adjacent to the prop head receiving portion and includes a first flange bore for supporting a first securing pin configured to engage the prop head in the mounted state, and a first receiving portion disposed adjacent to the first flange remote from the prop head receiving portion. The prop head bearing device may further comprise a first securing element including a first securing element bore and being adapted in shape to the first receiving portion, such that in the mounted state the first securing element is locked with respect to the bore direction of the first flange bore and that the first securing element bore is aligned to the first flange bore.

According to another aspect of the present disclosure, a shield support used in underground mining applications for supporting a roof may comprise a shield canopy including an outer surface configured to support the roof, and an inner surface configured to face towards a floor. The shield canopy may further comprise a prop head bearing device according to the present disclosure, which may be disposed at the inner surface of the shield canopy, and a hydraulic prop including a prop head configured to be pivotably received in the prop head receiving portion.

According to yet another aspect of the present disclosure, a method for securing a prop head of a hydraulic prop to a prop head bearing main body attached to a shield canopy of a shield support in underground mining applications is disclosed. The prop head bearing main body may include a prop head receiving portion, a first flange, which is disposed adjacent to the prop head receiving portion and includes a first flange bore for supporting a first securing pin configured to engage the prop head, and a first receiving portion disposed adjacent to the first flange remote from the prop head receiving portion. The disclosed method may comprise positioning a first securing element including a first securing element bore and being adapted in shape to the first receiving portion, such that the first securing element is locked with respect to the bore direction of the first flange bore and that the first securing element bore is aligned to the first flange bore. The method may further comprise inserting the first securing pin through the first securing element bore and the first flange bore, such that the prop head can be positioned in the prop head receiving portion, positioning the prop head including a first recess in the prop head receiving portion, and inserting the first securing pin into the first recess for securing the prop head to the prop head bearing main body.

According to yet another aspect of the present disclosure, a U-like shaped securing element configured to support a securing pin for locking a prop head of a hydraulic prop to a prop head bearing main body, and to be securely received at a receiving portion of the prop head bearing main body is disclosed. The U-like shaped securing element may comprise a base portion configured to contact and match with the receiving portion, a first post extending substantially perpendicular away from the base portion, a second post spaced apart the first post and extending substantially perpendicular away from the base portion and parallel to the first post, an open end disposed opposite from the base portion and being defined by ends of the first post and the second post, and a securing element bore surrounded by the base portion, the first post, the second post, and the open end.

Although a prop head bearing device for securing a prop head to the shield canopy of a shield support is disclosed, the exemplary disclosed principle of the prop head bearing device may also apply to the prop foot configured to be secured to skids of the shield support.

In some embodiments, the prop head bearing main body may further include a second flange disposed adjacent to the prop head receiving portion and opposite to the first flange. The second flange may include a second flange bore for supporting a second securing pin configured to engage the prop head in the mounted state. The prop head bearing main body may further include a second receiving portion with a second flange bore and being disposed adjacent to the second flange remote from the prop head receiving portion. The prop head bearing device may further comprise a second securing element including a second securing element bore and being adapted in shape to the second receiving portion, such that in the mounted state the second securing element is locked with respect to the bore direction of the second flange bore and that the second securing element bore is aligned to the second flange bore.

Other features and aspects of this disclosure will be apparent from the following description and the accompanying drawings.

DETAILED DESCRIPTION

Figure 1:
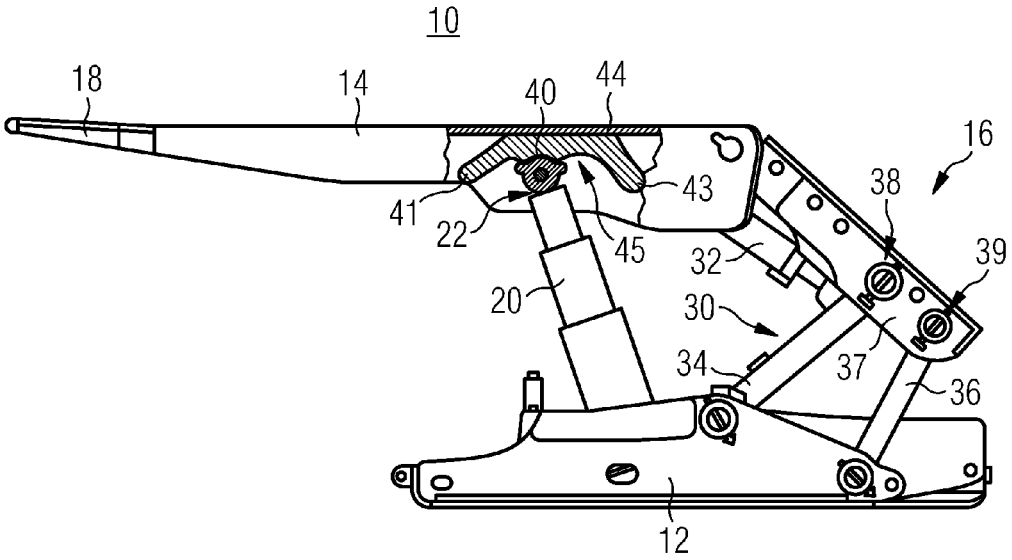
FIG. 1 is a schematic illustration of a shield support with a partial side cut view of an exemplary prop head bearing.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure may be based in part on the realization that providing a prop head bearing device with loosely received securing elements for supporting a securing pin may improve manufacturing of the prop head bearing main body and may facilitate, for example, the molding process of the prop head bearing main body.

The present disclosure may be further based in part on the realization that providing the prop head bearing main body in a trough-like shape may displace the weld seams configured to fixedly attach the prop head bearing main body to the shield support out of the area of high tensile stress. In such case, by providing the prop head bearing main body in the trough-like shape, the prop head bearing device may be only welded to web plates of the shield support and not by a circumferential weld seam encompassing the prop head bearing at the shield canopy. Thus, the prop head bearing may loosely contact the shield support with its shield canopy contacting surface. Particularly, the weld seam may circumferentially pass around the entire circumference of the side surface of the prop head bearing main body, which contacts a web plate.

The present disclosure may be further based in part on the realization that providing a prop head bearing device having at least one flange with a flange bore and a receiving portion configured to securely receive a securing element with a securing element bore may lead, when inserting a securing pin into the flange bore and the securing pin receiving bore, to a self-locking arrangement for locking the securing pin in a predetermined position. In particular, the securing pin may protrude into a recess disposed within a prop head for fixing the prop head to the prop head bearing device and, thus, for example, to the shield canopy. Specifically, the securing element may comprise a locking pin receiving bore for accommodating a locking pin configured to engage the securing pin having a groove circumferentially passing around the periphery of the securing pin.

Referring to FIG. 1 an exemplary embodiment of a shield support 10 to hold a longwall face (not shown) open. The shield support 10 comprises skids 12, a shield canopy 14, a gob shield 16, and hydraulic cylinders 20. The shield support 10 has two mutually adjacent to skids 12, which in underground mining are also referred to as floor skids, since they rest on the rock soil forming the floor of a face. On each skid 12, at least one multi-telescopic strong hydraulic cylinder 20 (in underground mining also referred to as a hydraulic prop) is supported. A prop head 22 of the hydraulic prop 20 presses from below against the shield canopy 14. Specifically, the prop head 22 is secured to a prop head bearing device 40, which in turn is attached to the shield canopy 14. The shield canopy 14, which is in underground mining also referred to as a roof canopy, presses against the rock which forms the ceiling of the face, the so-called roof The distance between the skids 12 and the shield canopy 14 can be adjusted by retraction or extension of the hydraulic prop 20. A link mechanism 30 ensures by means of the gob shield 16, as well as by means of a corner cylinder 32, that the skids 12 and the shield canopy 14, in each state of extension of the hydraulic prop 20, stand substantially plane-parallel to each other. The link mechanism 30 is exemplary configured as a lemniscate link mechanism. The link mechanism 30 has a front link 34 and a rear link 36, both being supported at a distance apart against two bolt receptacles 38 and 39 as well as against the skid 12.

The bolt receptacles 38, 39 are respectively configured on a side plate 37 of the gob shield 16, and the shield canopy 14 is connected to the gob shield 16 in an articulated manner by a hinge bolt. The corner cylinder 32, which is attached by its one end to a supporting bracket on the gob shield 16 and with its other end against the shield canopy 14, serves for the additional bracing of the articulated connection between the gob shield 16 and the shield canopy 14 and can be hydraulically loaded or unloaded as desired. Additionally, a shield canopy tip 18 may be connected to the shield canopy 14 in an articulated manner.

Figure 2:
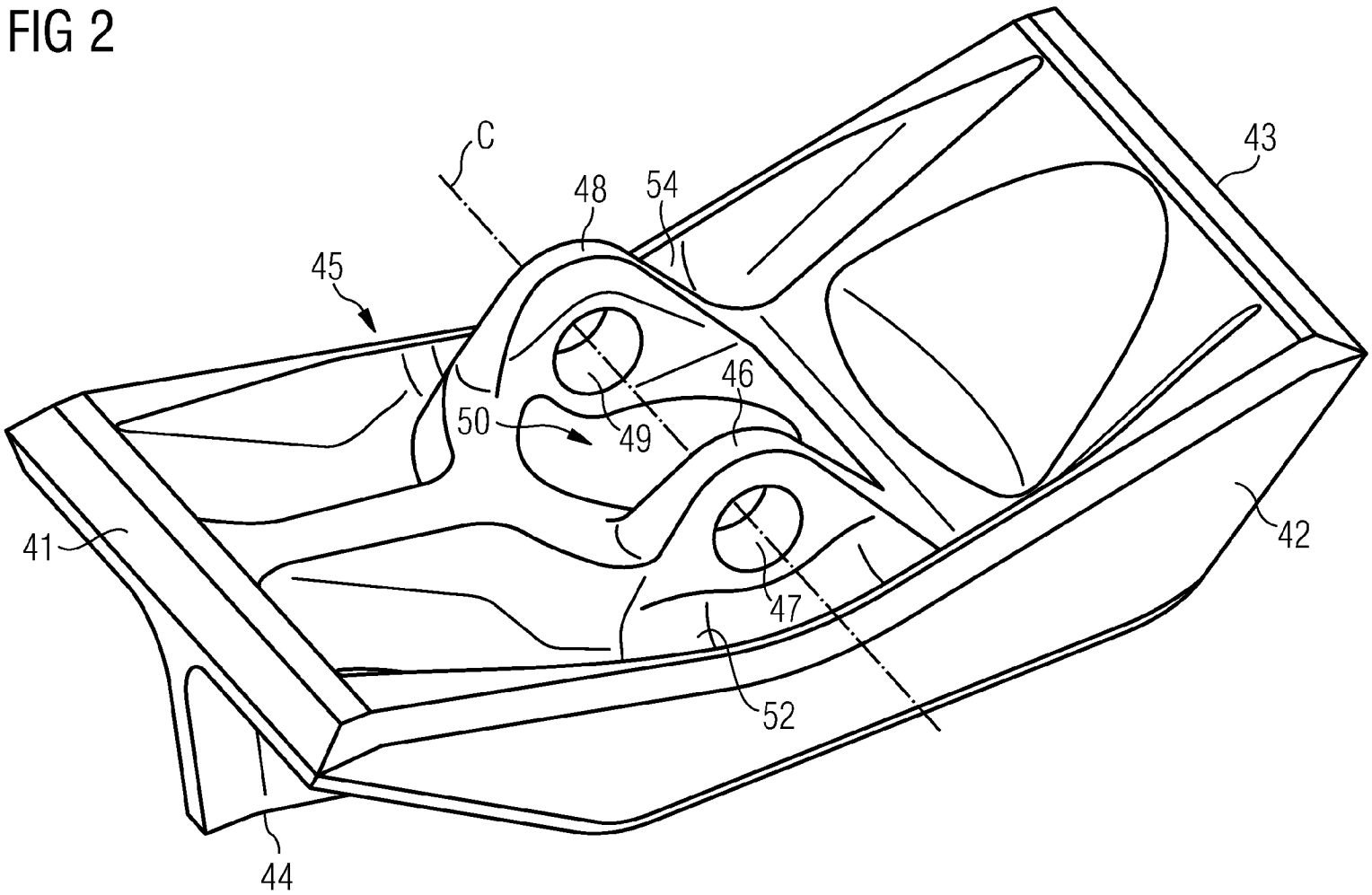
FIG. 2 is a perspective view of an exemplary prop head bearing.
Figure 3:
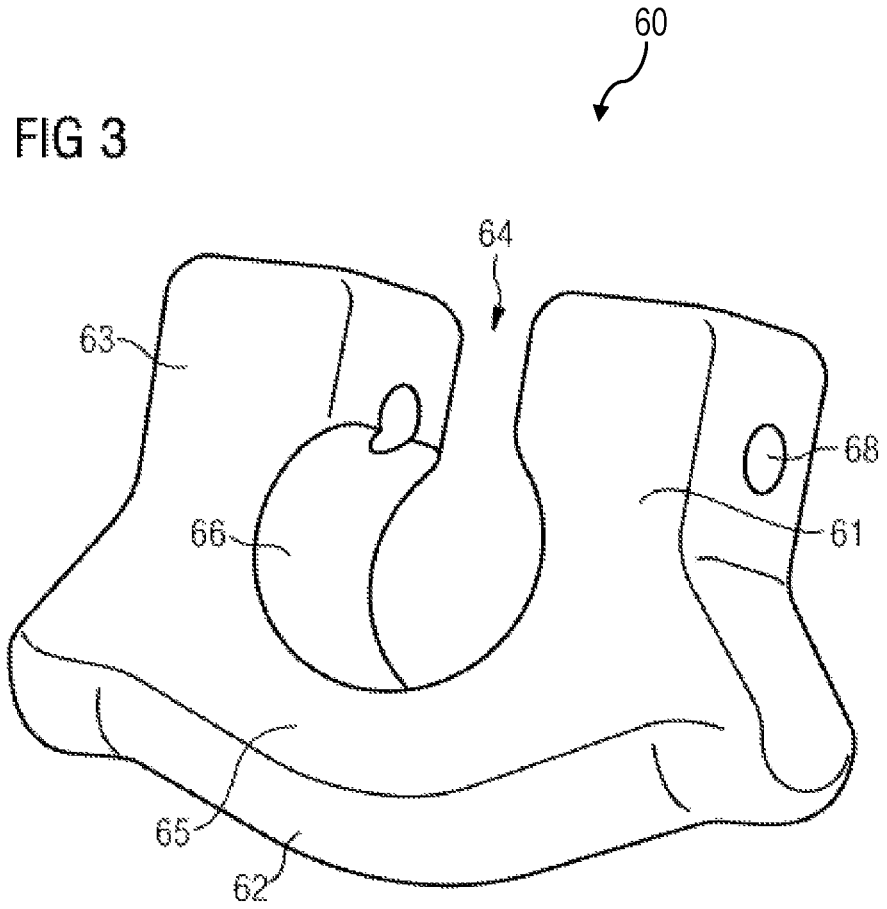
FIG. 3 is a perspective view of an exemplary securing element configured to be assembled to the prop head bearing.
Figure 4:
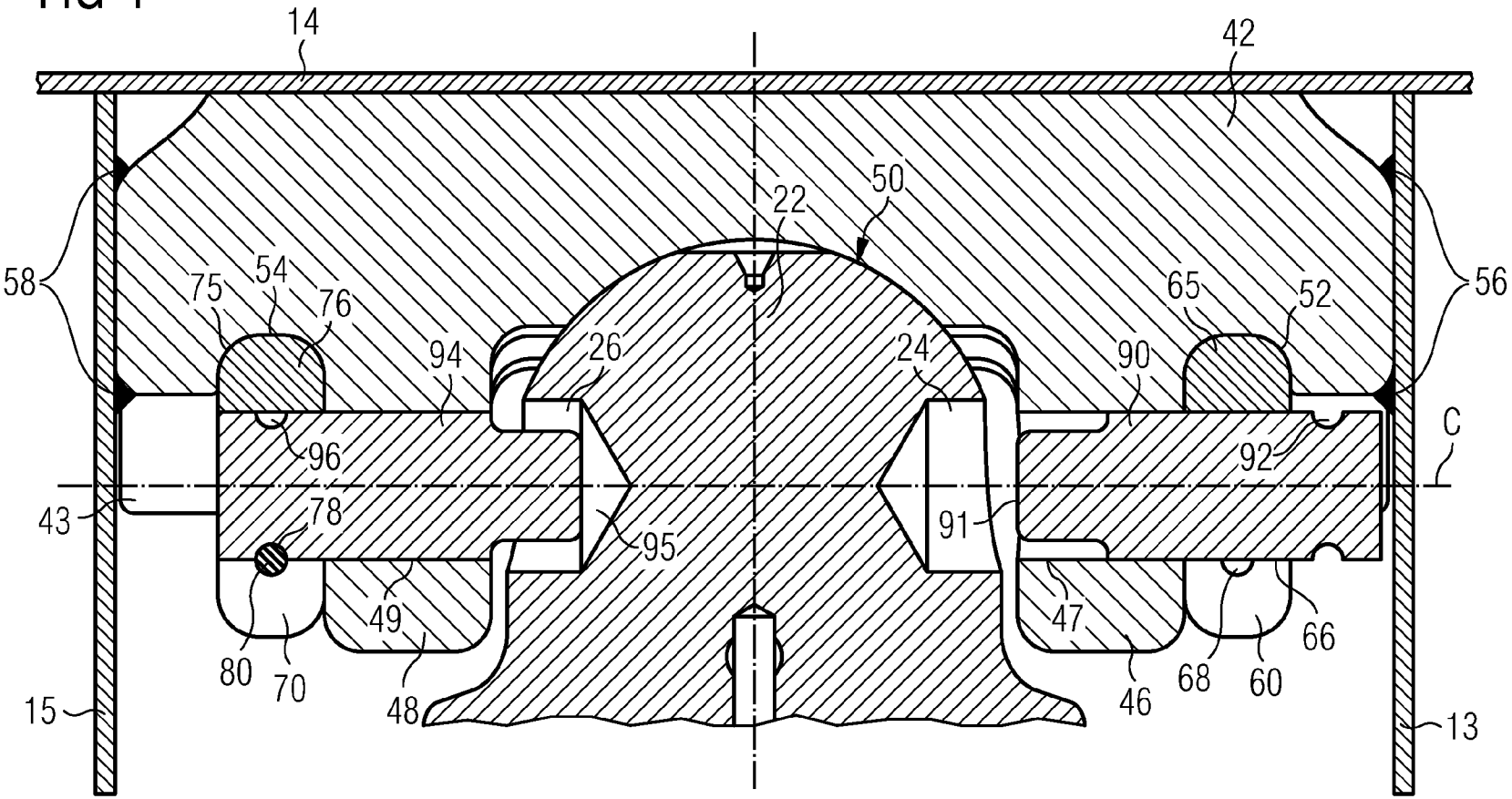
FIG. 4 is a cut view illustrating a prop head secured to the prop head bearing.

Referring to FIGS. 2, 3, and 4, the prop head bearing device 40 including a prop head bearing main body 42 and at least one securing element 60, 70 is shown in greater detail. The prop head bearing device 40 includes the prop head bearing main body 42, which may be, for example, a casted element. As shown in FIG. 2, the prop head bearing main body 42 is provided in a trough-like shape, such that a first end 41 is directed towards the shield canopy tip 18, and a second end 43 is directed towards the gob shield 16 (see also FIG. 1). A trough portion 45 may interconnect the first end 41 and the second end 43. It is further understood that the first and second end 41, 43 are offset from the shield canopy 14 towards the skid 12, whereas the through portion 45 is adjacent to the shield canopy 14 and provides a plane contact surface 44 for contacting the shield canopy 14.

The plane contact surface 44 is configured to loosely contact the shield canopy 40 from a lower side thereof (see, for example, FIG. 1). A first flange 46 protrudes from the prop head bearing main body 42 in a direction away from the contact surface 44 and, thus, away from the shield canopy 14. A second flange 48 protrudes from the prop head bearing main body 42 in a direction away from the contact surface 44 and, thus, away from the shield canopy 14.

As shown in FIG. 2, the first flange 46 and the second flange 48 are provided in a semi-circular plate-like shape. However, the first and second flanges may be provided in any appropriate shape. The plate-like shaped first flange 46 may extend substantially parallel with respect to a lateral side of the prop head bearing main body 42, and the plate-like shaped second flange 48 also extends substantially parallel with respect to a lateral side of the prop head bearing main body 42. Here, the lateral side is a side of the prop head bearing main body 42 that interconnects the first end 41 with the second end 43. In some embodiments, as also shown in FIG. 2, the first flange 46 may be parallel to the second flange 48.

The first flange 46 has a first flange bore 47, and the second flange 48 has a second flange bore 49 aligned to the first flange bore 47, as indicated in FIG. 2 by an axis C. Both the first flange bore 47 and the second flange bore 49 laterally extend through the first flange 46 and the second flange 48, respectively, with respect to a thickness direction of the first and second flanges 46, 48. The axis C extends in a direction perpendicular to a longitudinal extension direction of the prop head bearing main body 42, which means that the axis C is perpendicular to a direction from the first end 41 to the second end 43.

The first flange 46 is spaced apart the second flange 48 thereby defining a prop head receiving portion 50 therebetween. The prop head receiving portion 50 is configured to loosely receive and pivotably accommodate the prop head 22 of the hydraulic prop 20. The specific connection of the prop head 22 to the prop head bearing device 40 is described in greater detail with reference to FIG. 4 below.

Further, as shown in FIG. 2, a first receiving portion 52 may be disposed adjacent to the first flange 46 and remote from the prop head receiving portion 50. Here, remote from the prop head receiving portion 50 means a side of the first flange 46 opposite to the side where the prop head receiving portion 50 is disposed with respect to the first flange 46. Specifically, the first receiving portion 52 may be disposed between the first flange 46 and the lateral side of the prop head bearing main body 42 next to the first flange 46. In some embodiments, the first receiving portion 52 may be provided in a concave shape, for example, as at least a partial groove extending perpendicular to the axis C. However, in some embodiments, the first receiving portion 52 may be provided in a convex shape, for example, as a rib extending perpendicular to the axis C.

Similarly, a second receiving portion 54 may be disposed outwardly of the second flange 48 with respect to the prop head receiving portion 50. Specifically, the second receiving portion 54 may be disposed between the second flange 48 and the lateral side of the prop head bearing main body 42 next to the second flange 48. The second receiving portion 54 may also be provided in a concave shape, for example, as at least a partial groove extending perpendicular to the axis C. However, in some embodiments, the second receiving portion 54 may be provided in a convex shape, for example, as a rib extending perpendicular to the axis C.

The first and second receiving portions 52, 54 provided may have a straight shape or a non-straight shape with respect to the longitudinal direction, as indicated in FIG. 2. Here, a non-straight shape is referred to a longitudinal groove which may include peaks and valleys in its longitudinal direction. In some embodiments, the first and second receiving portions 52, 54 may be provided as a flat surface including, for example, a rib-like shaped protrusion configured to match and axially secure a securing element 60, 70 (shown in FIGS. 3 and 4).

The first receiving portion 52 and the second receiving portion 54 are configured to loosely receive a first securing element 60 and a second securing element 70, respectively (see FIG. 4). An exemplary detailed embodiment of the first securing element 60 is described with reference to FIG. 3. However, it is to be understood that the second securing element may include a same design and, thus, same features as the first securing element 60, such that the first securing element 60 may be identically constructed as the second securing element and may comprise same features.

Turning now to FIG. 3, the first securing element 60 is shown in greater detail. As shown in FIG. 3, the first securing element 60 comprises a base portion 65 including contacting surface 62 configured to loosely contact the first receiving portion 52. The shape of the base portion 65 may substantially correspond to the shape of the receiving portion 52. Therefore, as shown in FIG. 3, the base portion 65 may include a concave or a convex shape, such as, for instance, a rounded shape matching with the groove-like shaped first receiving portion 52. Thus, when the first receiving portion 52 is provided as, for example, a rounded groove, the base portion 65 may comprise a shape such that the base portion 65 of the first securing element 60 fits into the groove. It is further to be understood that, in the case when the receiving portion 52 is provided in a non-straight shape with peaks and valleys, the base portion 65 may also comprise such peaks and valleys at the contacting surface 62 for form-fitting with the first or second contacting surface 52.

When being positioned at the first receiving portion 52, the first securing element 60 is axially secured with respect to the extension direction of the axis C, as the base portion 65 matches with the receiving portion 52, which may be provided, for example, as a groove. Similarly, a second securing element 70 (see FIG. 4) may be axially secured by and received in the second receiving portion 54 matching with a contacting surface of the second securing element 70.

As illustrated in FIG. 3, the first securing element 60 is provided in a U-shape, wherein an open end 64 is opposite the base portion 65. Particularly, the first securing element 60 comprises a first post 61 and a second post 63. The base portion 65, the first post 61, and the second post 63 form the U-like shaped first securing element 60. However, in some embodiments, the first securing element 60 may be provided as a closed plate-like member, which means that no open end 64 may be provided.

The first securing element 60 further comprises a first securing element bore 66 surrounded by the base portion 65, the first post 61, the second post 63, and the open end 64. When being assembled to the prop head bearing main body 42, the first securing element bore 66 is configured to be aligned with the first flange bore 47 of the first flange 46.

As additionally indicated in FIG. 3, the first securing element 60 further includes a locking pin receiving bore 68 extending substantially perpendicular to the first securing element bore 66. The locking pin receiving bore 68 is configured to receive a locking pin 80 (see FIG. 4) for locking a first securing pin 90 passing through the first flange bore 47 and the first securing element bore 66 in its specific positions, as described with reference to FIG. 4.

INDUSTRIAL APPLICABILITY

In the following, an exemplary method for mounting the prop head 22 to the prop head bearing device 40 is described with respect to FIG. 4.

FIG. 4 illustrates the prop head bearing device 40 mounted to a shield support 10, especially to a shield canopy 14. The shield support 10 includes a first web plate 13 and a second web plate 15 spaced apart the first web plate 13, wherein both being fixedly attached to the shield canopy 14 by way of, for instance, welding, such that the first and second web plates 13, 15 extend perpendicularly from the shield canopy 14 in the direction to the skids 12. The contact surface 44 of the prop head bearing main body 42 loosely abuts an inner side of the shield canopy 14 at a portion between the first and second web plates 13, 15. The lateral sides of the prop head bearing main body 42 are fixedly attached and secured to first and second web plates 13, 15, respectively, by means of, for instance, welding.

For example, a first weld seam 56 may be provided to attach the prop head bearing main body 42 to the first web plate 13, and a second weld seam 58 may be provided to attach the prop head bearing main body 42 to the second web plate 15. The first and second weld seams 56, 58 may each pass around the circumference of the side surfaces of the prop head bearing main body 42 (see, for example, FIG. 2). Thus, the first and second weld seams 56, 58 may not be directly in the area of high tensile stress, which means that no weld seams are at the interface between the contacting surface 44 of the prop head bearing main body 42 and the shield canopy 14.

In a first step, the first securing element 60 and a second securing element 70 are positioned in the first receiving portion 52 and the second receiving portion 54, respectively. As indicated in the cross-sectional view of FIG. 4, the first and second receiving portions 52, 54 are groove-like shaped, wherein the first and second base portions 65, 75 of the first and second securing elements 60, 70 match with the respective grooves of the first and second receiving portions 52, 54. In such case, after having the first and second securing elements 60, 70 positioned therein, the first and second securing elements 60, 70 are axially secured with respect to the extension direction of the axis C. In some embodiments, the first and second receiving portions 52, 54 may be provided in a rectangular shape, a triangular shape, or any other shape suitable for axially securing the first and second securing elements 60, 70 against axially displacement and, thus, against axially disengaging the first and second receiving portions 52, 54.

When the first and second securing elements 60, 70 are positioned at the first and second receiving portions 52, 54, respectively, in a next step, first and second securing pins 90, 94 are inserted into the first and second flange bores 47, 49 and the first and second securing element bores 66, 76, respectively. As the prop head bearing is welded to the first and second web plates 13, 15, the first and second securing pins 90, 94 are inserted into the first and second flange bores 47,49 and the first and second securing element bores 66, 76 from the prop head receiving portion 50 and are then pushed outwardly in the direction of the first and second securing elements 60, 70, such that the first and second securing pins 90, 94 do not protrude into the prop head receiving portion 50 defined by the first and second flanges 46, 48. This assembly position is shown at the right side of FIG. 4, where the first securing pin 90 does not protrude into the prop head receiving portion 50.

Subsequently, the prop head 22 is positioned in the prop head receiving portion 50 in a pivotable manner. The longitudinal axis C of the first and second securing pins 90, 94 is configured to coincide with the swivel axis of the hydraulic prop 20. Thus, a pivotable motion of the prop head 22 secured to the prop head bearing device 40 is possible.

After having the prop head 22 positioned in the prop head receiving portion 50, the first securing pin 90 is pushed back in the direction of the prop head receiving portion 50, such that an end 91 of the first securing pin 90 facing the prop head 22 engages in a first recess 24 of the prop head 22 for securing the prop head 22 to the prop head bearing device 40. Similarly, although not explicitly shown in FIG. 4, the second securing pin 94 is also pushed back in the direction of the prop head receiving portion 50, such that an end 95 of the second securing pin 94 facing the prop head 22 engages in a second recess 26 of the prop head 22 for securing the prop head 22 to the prop head bearing device 40.

As indicated in FIG. 4, since the first and second securing elements 60, 70 are provided in a U-like shape, wherein the open end 64 facing towards the skids 12, pushing of the first and second securing pins 90, 94 into the first and second recesses 24, 26, respectively, is facilitated as, for example, an operator may have sufficient access to the first and second securing pins 90, 94 for axially displacing the same. Specifically, by assistance of a specific tool, the operator may be able to have access to the securing pins 90, 94 such that displacement of the same is facilitated.

As further illustrated in FIG. 4, the first and second securing pins 90, 94 each include a groove 92 and 96, respectively. The grooves 92, 96 run all around the periphery of the first and second securing pins 90, 94 with a semicircular cross-section.

After the first and second securing pins 90, 94 engaged the first and second recesses 24, 26, respectively, locking pins 80 are inserted into the respective locking pin receiving bores 68, 78 engage with the grooves 92, 96, respectively, thereby locking the first and second securing pins 90, 94 against axial motion. The locking pins 80 may itself be secured by spring clips (not shown) against axial displacement. This locking position is shown in FIG. 4 at the left side, where the end 95 of the second securing pin 94 engages the second recess 26 of the prop head 22, and the locking pins 80 engage the grooves 92, 96.

As also shown in FIG. 4, in the locking position, as the locking pins 80 engage the grooves 92, 96, the first and second securing pins 90, 94 are prevented from being shifted in either axial direction thereof.

Although the preferred embodiments of this invention have been described herein, improvements and modifications may be incorporated without departing from the scope of the following claims.

The invention claimed is:

1. A prop head bearing device configured to be attached to a shield canopy of a shield support in underground mining applications and to receive a prop head of a hydraulic prop, comprising:

a prop head bearing main body including:

a prop head receiving portion;

a first flange disposed adjacent to the prop head receiving portion and including a first flange bore for supporting a first securing pin configured to engage the prop head in the mounted state; and a first receiving portion disposed adjacent to the first flange and remote from the prop head receiving portion, the first receiving portion including a groove; and a first securing element disposed in the groove, the first securing element including a first securing element bore and being adapted in shape to the first receiving portion, such that in the mounted state the first securing element is locked with respect to the bore direction of the first flange bore and that the first securing element bore is aligned to the first flange bore.

2. The prop head bearing device of claim 1, wherein the prop head bearing main body further includes:

a second flange disposed adjacent to the prop head receiving portion and opposite to the first flange, the second flange including a second flange bore for supporting a second securing pin configured to engage the prop head in the mounted state; and a second receiving portion disposed adjacent to the second flange and remote from the prop head receiving portion, and the prop head bearing device further comprises a second securing element including a second securing element bore and being adapted in shape to the second receiving portion, such that in the mounted state the second securing element is locked with respect to the bore direction of the second flange bore and that the second securing element bore is aligned to the second flange bore.

3. The prop head bearing device of claim 1, wherein the first securing element includes a base portion having a shape matching with the groove-like shaped first receiving portion.

4. The prop head bearing device of claim 1, wherein the first securing element is U-shaped with an open end opposite to the base portion of the first securing element.

5. The prop head bearing device of claim 1, wherein the first securing element includes a locking pin receiving bore configured to receive a locking pin, the locking pin receiving bore extending substantially perpendicular with respect to the first securing element bore.

6. The prop head bearing device of claim 1, wherein the prop head bearing main body further includes a first end, a second end opposite to the first end, and a trough portion interconnecting the first end and the second end, the first end and the second end being disposed at a different altitude than the trough portion, thereby forming a trough-like shaped prop head bearing main body.

7. The prop head bearing device of claim 1, wherein the first receiving portion receives the first securing element in a manner, such that rotation of the first securing element is prevented.

8. A shield support used in underground mining applications for supporting a roof, comprising:

a shield canopy including an outer surface configured to support the roof, and an inner surface configured to face towards a floor;

a prop head bearing device disposed at the inner surface of the shield canopy, the prop head bearing device comprising:

a prop head bearing main body including:

a prop head receiving portion;

a first flange disposed adjacent to the prop head receiving portion and including a first flange bore for supporting a first securing pin configured to engage the prop head in the mounted state; and a first receiving portion disposed adjacent to the first flange and remote from the prop head receiving portion, the first receiving portion including a groove; and a first securing element disposed in the groove, the first securing element including a first securing element bore and being adapted in shape to the first receiving portion, such that in the mounted state the first securing element is locked with respect to the bore direction of the first flange bore and that the first securing element bore is aligned to the first flange bore; and a hydraulic prop including a prop head configured to be pivotably received in the prop head receiving portion.

9. The shield support of claim 8, further comprising:

a first web plate fixedly attached to the inner surface of the shield canopy, the first web plate extending substantially perpendicular from the inner surface of the shield canopy towards the floor; and a second web plate disposed spaced apart of the first web plate and fixedly attached to the inner surface of the shield canopy, the second web plate extending substantially perpendicular from the inner surface of the shield canopy towards the floor, wherein the prop head bearing device is disposed between the first web plate and the second web plate.

10. The shield support of claim 9, wherein the prop head bearing device is fixedly attached to the first web plate and the second web plate.

11. The shield support claim 8, further comprising a first securing pin extending through the first flange bore of the first flange and through the first securing element bore of the first securing element.

12. A method for securing a prop head of a hydraulic prop to a prop head bearing main body attached to a shield canopy of a shield support in underground mining applications, the prop head bearing main body including a prop head receiving portion, a first flange, which is disposed adjacent to the prop head receiving portion and includes a first flange bore for supporting a first securing pin configured to engage the prop head, and a first receiving portion including a groove and being disposed adjacent to the first flange and remote from the prop head receiving portion, the method comprising:

positioning a first securing element in the groove of the first receiving portion, the first securing element including a first securing element bore and being adapted in shape to the first receiving portion, such that the first securing element is locked with respect to the bore direction of the first flange bore and that the first securing element bore is aligned to the first flange bore;

inserting the first securing pin through the first securing element bore and the first flange bore, such that the prop head can be positioned in the prop head receiving portion;

positioning the prop head including a first recess in the prop head receiving portion; and inserting the first securing pin into the first recess for securing the prop head to the prop head bearing main body.

13. The method of claim 12, wherein the prop head bearing main body further includes a second flange, which is disposed adjacent to the prop head receiving portion and opposite to the first flange and includes a second flange bore for supporting a second securing pin configured to engage the prop head, and a second receiving portion disposed adjacent to the second flange and remote from the prop head receiving portion, the method further comprising:

positioning a second securing element including a second securing element bore and being adapted in shape to the second receiving portion, such that the second securing element is locked with respect to the bore direction of the second flange bore and that the second securing element bore is aligned to the second flange bore;

inserting the second securing pin through the second securing element bore and the second flange bore, such that the prop head can be positioned in the prop head receiving portion;

positioning the prop head including a second recess in the prop head receiving portion; and inserting the second securing pin into the second recess for securing the prop head to the prop head bearing main body.

14. The method of claim 12, wherein the first securing element includes a locking pin receiving bore extending substantially perpendicular with respect to the first securing element bore, the method further comprising:

inserting a locking pin into the locking pin receiving bore, the locking pin being configured to engage with the first securing pin, such that the first securing pin is axially locked in its extending direction.

* * * * *